US006250967B1

(12) United States Patent
Chu

(10) Patent No.: US 6,250,967 B1
(45) Date of Patent: Jun. 26, 2001

(54) MOBILE VIDEO DEVICE

(76) Inventor: Fa-Yu Chu, 1F, No. 3, Sec. 5, Yen-Ping N. Rd., Shih-Lin Dist., Taipei (TW)

( * ) Notice: Subject to any disclaimer, the term of this patent is extended or adjusted under 35 U.S.C. 154(b) by 0 days.

(21) Appl. No.: 09/502,457

(22) Filed: Feb. 11, 2000

(51) Int. Cl.[7] ..... H01R 17/18

(52) U.S. Cl. ..... 439/668; 297/217.3; 439/534; 439/823

(58) Field of Search ..... 439/131, 534, 439/668, 669, 823, 455, 929; 297/217.3, 217.4

(56) References Cited

U.S. PATENT DOCUMENTS 3,019,050 * 1/1962 Spielman .
3,546,657 * 12/1970 Cook .
4,097,111 * 6/1978 Martin ..... 339/183
4,647,980 * 3/1987 Steventon et al. ..... 358/254
5,267,775 * 12/1993 Nguyen ..... 297/217
5,409,403 * 4/1995 Falossi et al. ..... 439/668
5,507,556 * 4/1996 Dixon ..... 297/217.3
5,713,633 * 2/1998 Lu ..... 297/217.3

* cited by examiner

*Primary Examiner*—Tulsidas Patel
*Assistant Examiner*—Thanh-Tam Le
(74) *Attorney, Agent, or Firm*—Bacon & Thomas, PLLC

(57) ABSTRACT

A coupling structure for mobile video device provided with multiple output signal terminals and a pair of commensurable multi-terminal jacks for easy and rapid installation or maintenance, and with a multistage adjustment device for adjusting the mobile video device in multiple steps.

4 Claims, 9 Drawing Sheets

MOBILE VIDEO DEVICE

BACKGROUND OF THE INVENTION

This invention relates to a coupling structure for mobile video device, particularly to a coupling structure for mobile video device provided with multiple output terminals and a commensurable multi-terminal jack for easy installation and maintenance and a multistage adjustment device for multi-stage adjustment.

Subsequent to the soaring popularity of the personal mobile video device, convenience of maintenance job is considered more important than ever, however, as the wiring in a conventional mobile video device is usually coupled in way of point or cup joint, it would be rather troublesome to open the seat for wire-cutting and wire-connecting when maintaining.

In a coupling structure for the conventional mobile video device shown in FIG. 1, a video device C is disposed in a pillow A, wherein a plurality of signal transmission lines C1 penetrates through a branch pipe A1 of the video device C, then is sleeve-jointed with an adopter C2 which is coupled to a signal transmission line D extended out of a seat B; and another branch pipe A1 is swiveled to lock on a pipe end A2.

In view of abovesaid imperfection in maintenance, after years of constant effort in research, the inventor of this invention has consequently developed and proposed an improved coupling structure pertaining to the subject matter.

SUMMARY OF THE INVENTION

This invention is proposed to provide a coupling structure for mobile video device with multiple output terminals and a commensurable multi-terminal jack for easy installation and maintenance and a multistage adjustment device for multistage adjustment.

For a better understanding to the present invention, together with further advantages or features thereof, at least one preferred embodiment will be elucidated below with reference to the annexed drawings.

DETAILED DESCRIPTION OF THE PREFERRED EMBODIMENT

Figure 1:
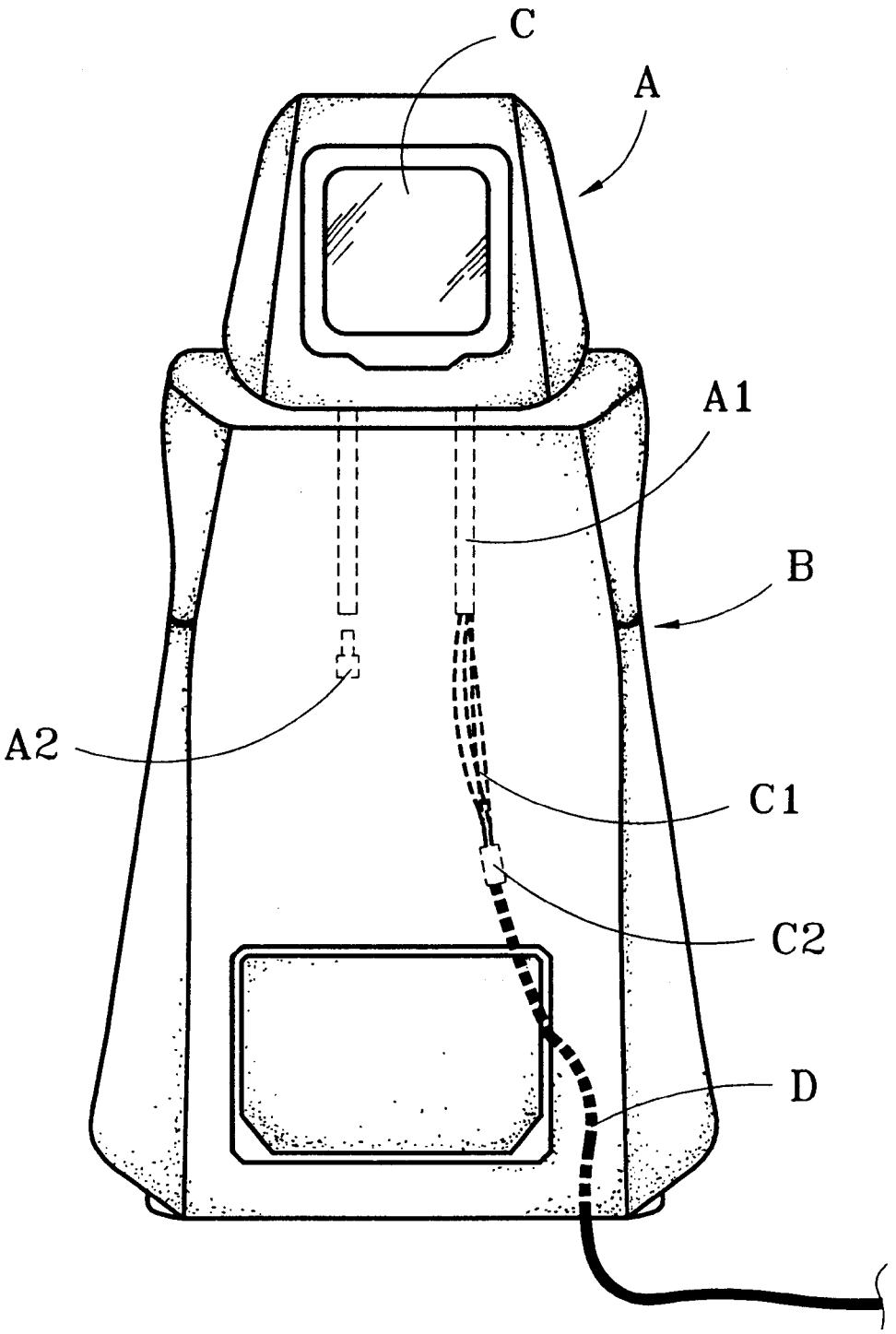
FIG. 1 is a schematic coupling structure for a conventional mobile video device.
Figure 2:
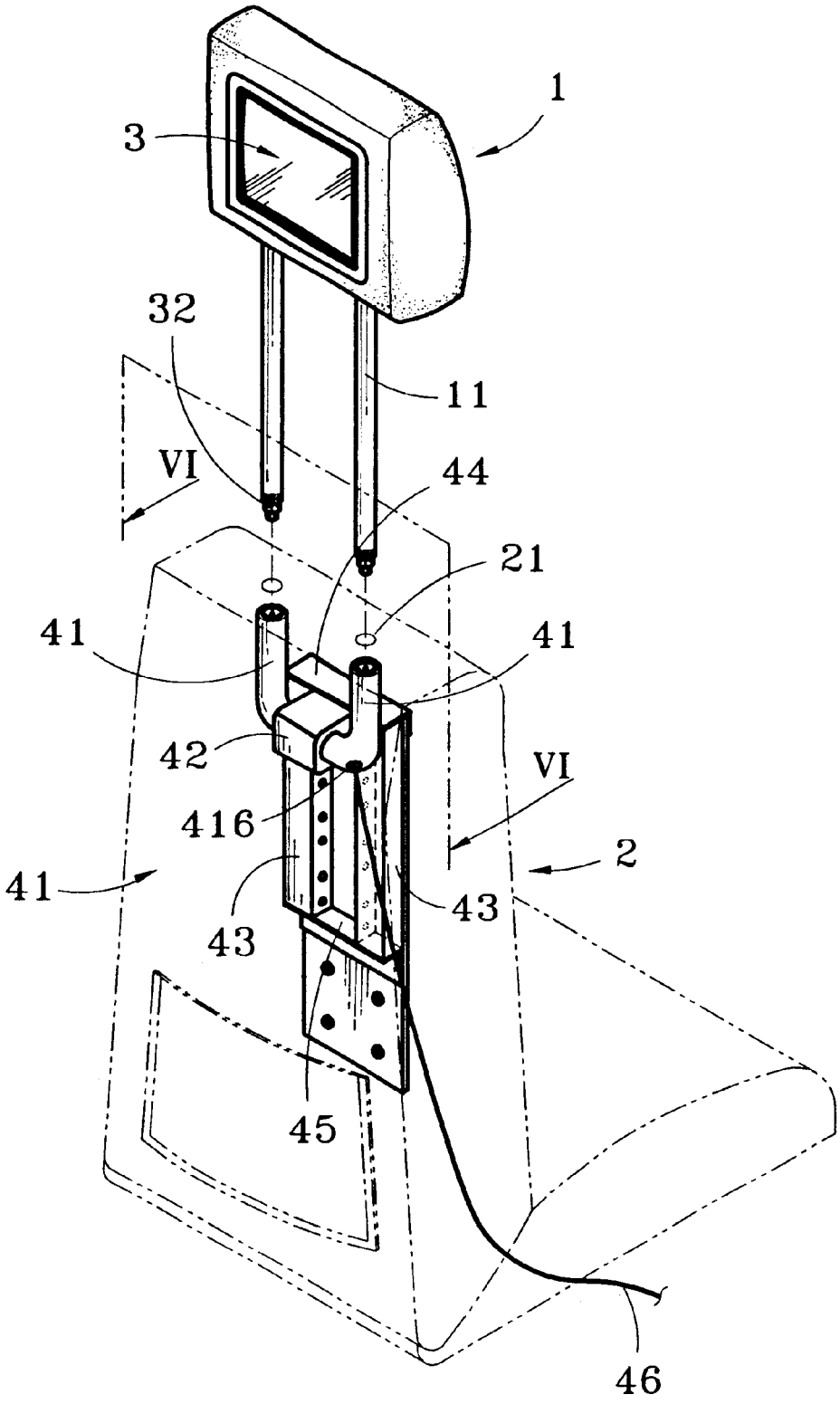
FIG. 2 is a schematic coupling structure for a mobile video device of this invention.
Figure 3A:
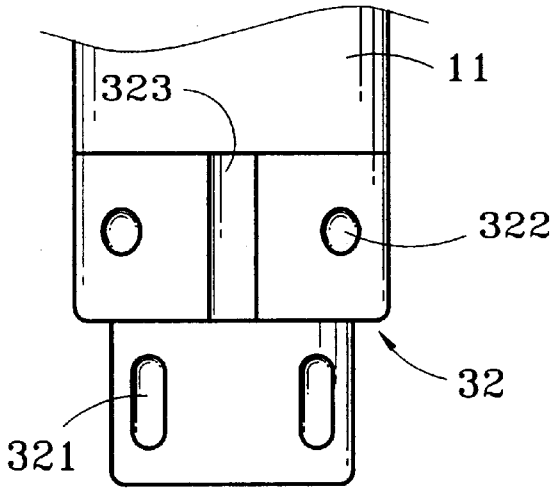
FIG. 3A is a schematic view showing a structure of signal terminal (1) of this invention.
Figure 3B:
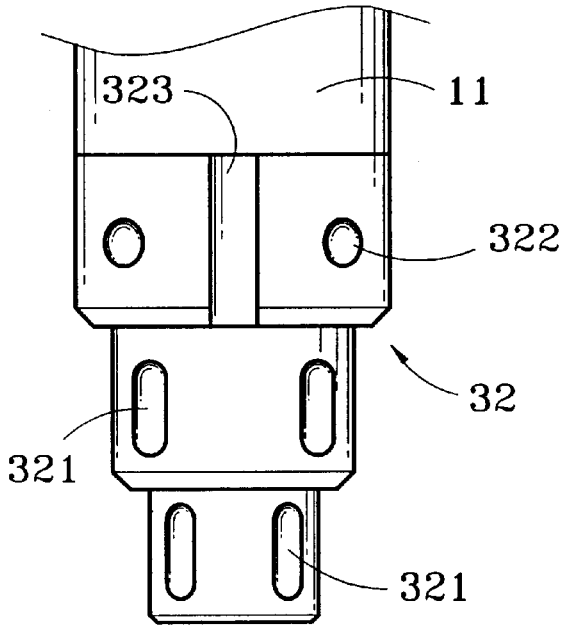
FIG. 3B is a schematic view showing a structure of signal terminal (2) of this invention.
Figure 3C:
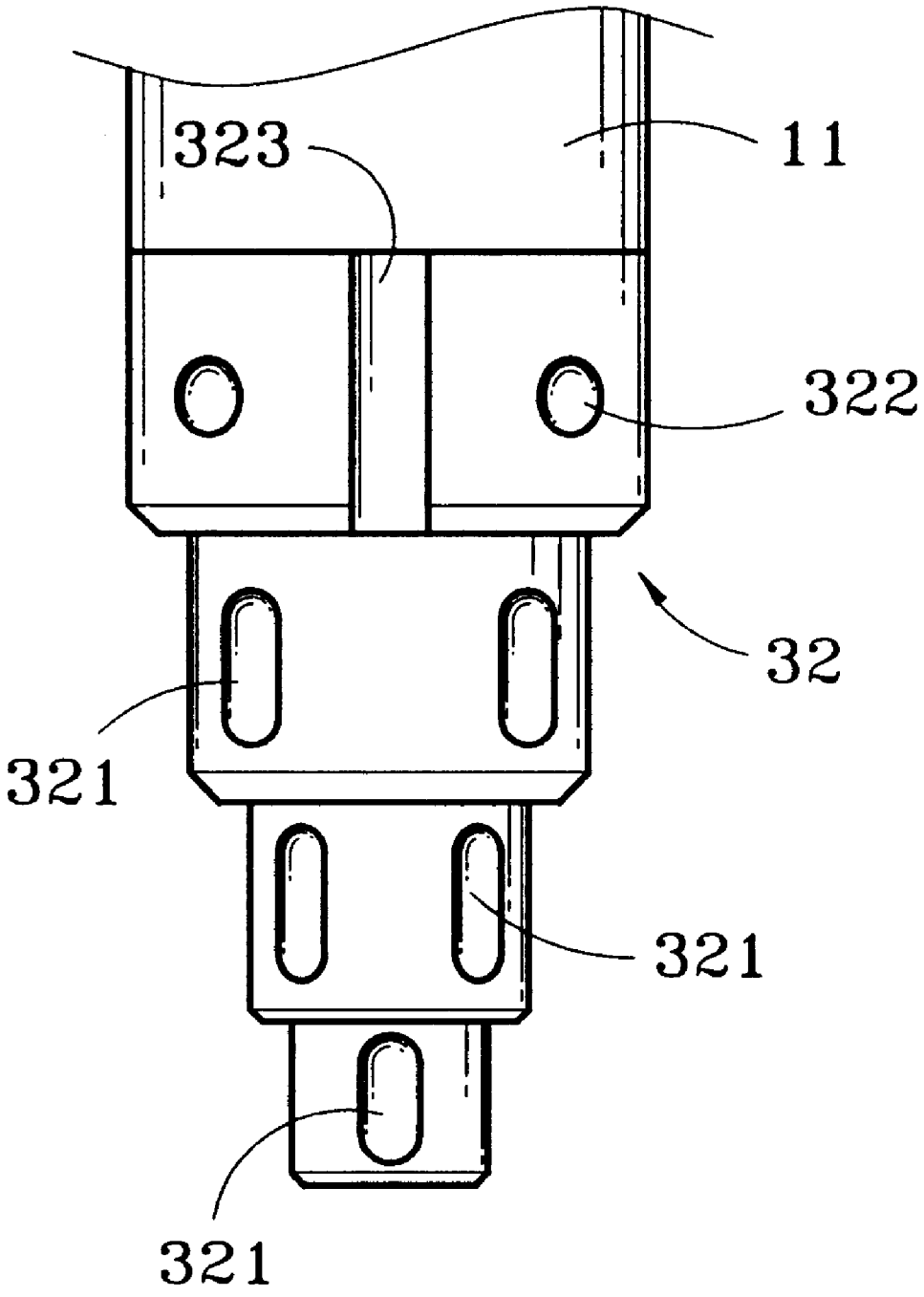
FIG. 3C is a schematic view showing a structure of signal terminal (3) of this invention.
Figure 4A:
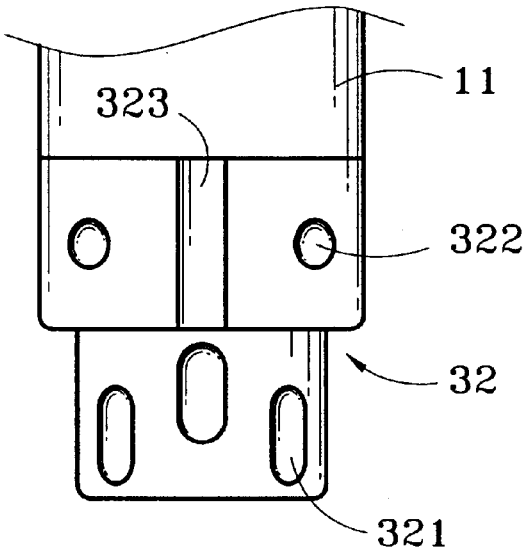
FIG. 4A is a schematic view showing another structure of signal terminal (1) of this invention.
Figure 4B:
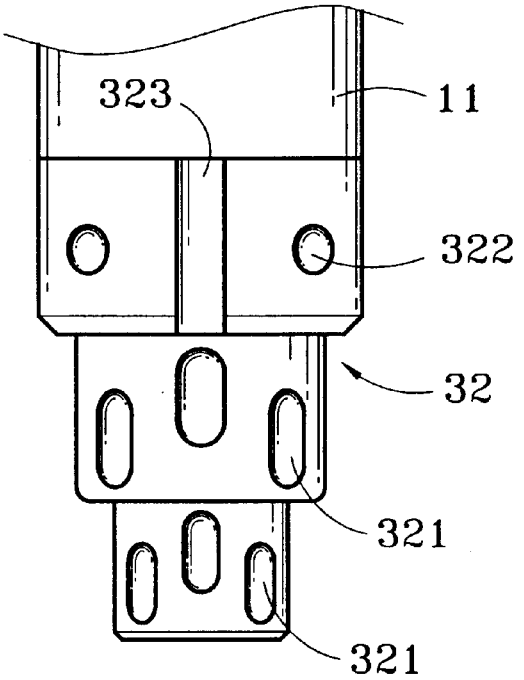
FIG. 4B is a schematic view showing another structure of signal terminal (2) of this invention.
Figure 4C:
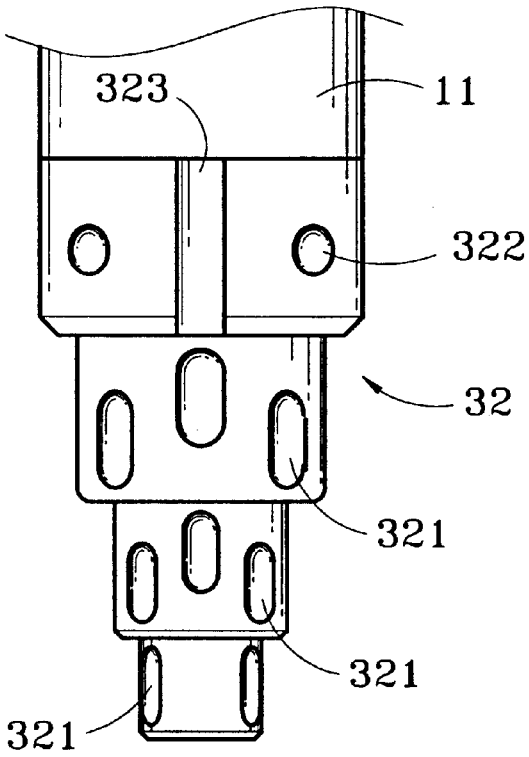
FIG. 4C is a schematic view showing another structure of signal terminal (3) of this invention.
Figure 4D:
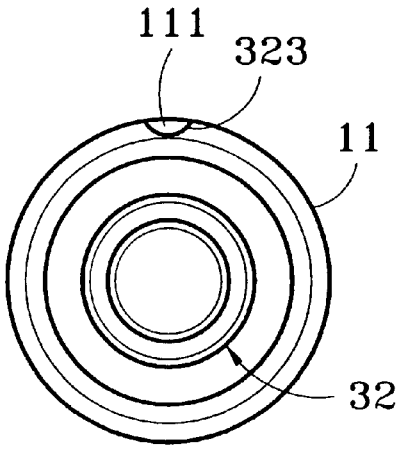
FIG. 4D is a schematic bottom view of another signal terminal of this invention.

As shown in FIG. 2, a mobile video device 3 is included in a pillow 1, wherein a signal transmission line 31 penetrated through a branch pipe 11 is coupled with a signal terminal 32 located at one end of the branch pipe 11. A pair of the branch pipes 11 of the pillow 1 is plugged in two insertion holes 21 of a seat portion 2 and snap-fastened to a pair of terminal jacks 41 of an adjustment device 4. The mobile video device 3 is movable up and down along a pair of displacement rails 43 in virtue of a displacement block 42. At an upper and a lower end of the adjustment device 4, an upper and a lower stopper 44, 45 are disposed respectively for easy dismounting or mounting of the mobile video device 3. And, an exit hole 416 is perforated at a bottom end of the terminal jack 41 for extending a signal transmission line 46.

Referring to FIG. 3A through FIG. 3C and FIG. 4A through FIG. 4D, a plurality of signal contact points 321 is offered to each of the signal terminals 32 according to requirement of the increasing functions of the mobile video device 3. The signal terminal 32 is lengthened in a multi-layer structure for accommodating the contact points 321, which may be aligned horizontally or staggeringly, and a plurality of receptacles or slots 322 is also arranged in the signal terminal 32. A positioning groove 323 is formed in the signal terminal 32, and a positioning piece 111 is disposed on the branch pipes 11 to facilitate wiring of the signal terminal 32 correctly and prevent the signal terminal 32 from causing a short circuit because of improper swiveling, and one or two sets of the signal terminal 32 may be arranged depending on functions provided by the mobile video device 3.

Figure 5A:
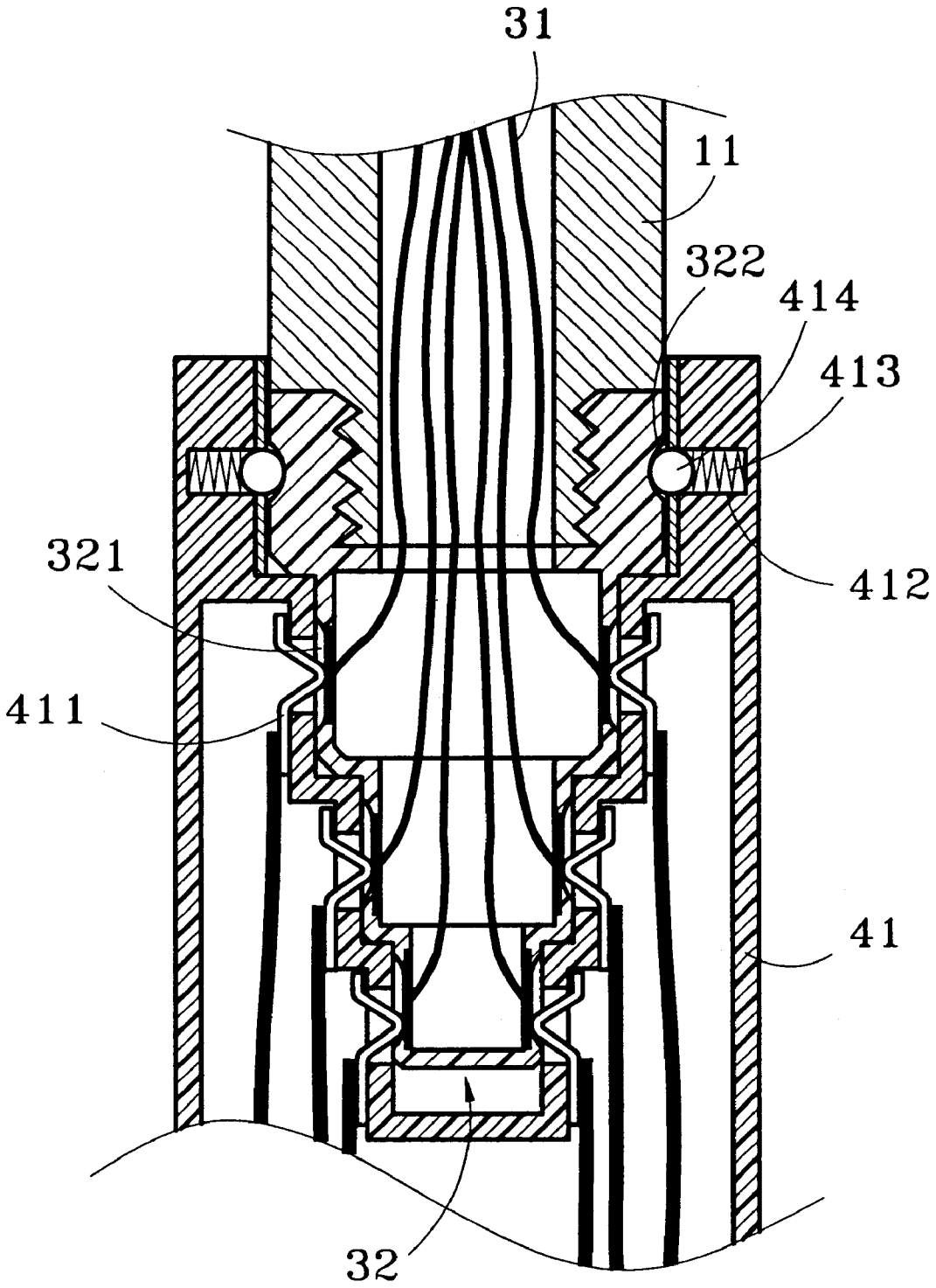
FIG. 5A is a schematic view showing a signal terminal being coupled with a terminal jack (1) of this invention.
Figure 5B:
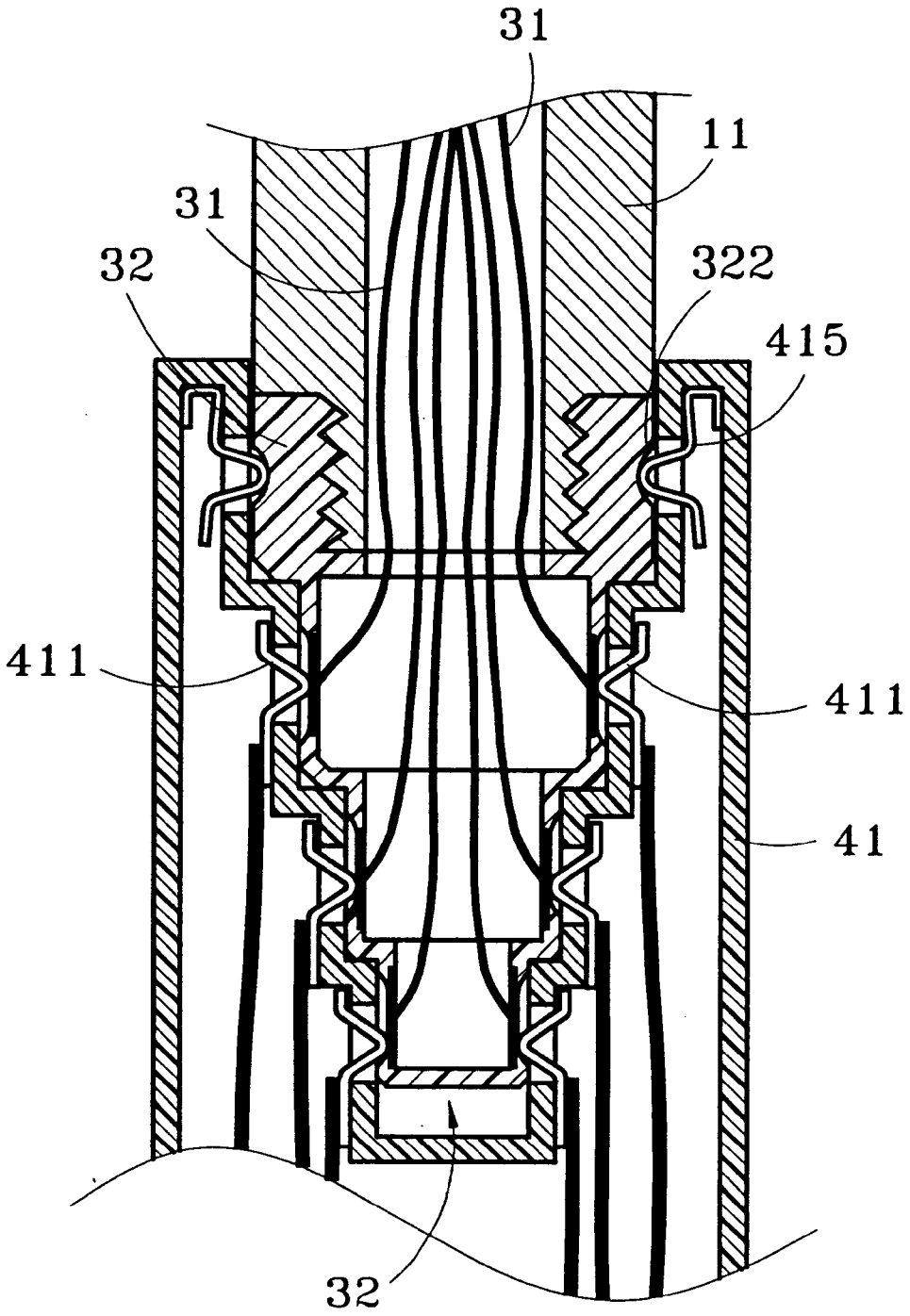
FIG. 5B is a schematic view showing a signal terminal being coupled with a terminal jack (2) of this invention.

As shown in FIGS. 5A and 5B, a plurality of storage receptacles 412 is formed in the inner wall of the terminal jack 41, wherein an elastomer 413 and a steel bead 414 are buried in the storage receptacle 412 in sequence. A plurality of positioning dimples 322 is formed on the signal terminal 32 at positions corresponding with the storage receptacles 412 of the terminal jack 41. Therefore, the steel bead 414 of the terminal jack 41 is pushed by the elastomer 413 into the positioning dimple 322 of the signal terminal 32 when the terminal 32 is plugged to joint with the terminal jack 41, and thereby a short circuit owing to improper swivel of the signal terminal 32 can be avoided. At this moment, the signal contact point 321 of the signal terminal 32 is in conductive contact with a signal contact point 411 of the terminal jack 41.

In another way of coupling the signal terminal 32 with the terminal jack 41, a plurality of elastic pieces 415 is disposed in the inner wall of the terminal jack 41 and a plurality of positioning dimples 322 on the signal terminal 32 at positions corresponding with the elastic pieces 415. Hence, the elastic piece 415 is snap-retained in the positioning dimple 322 when the signal terminal 32 is plugged to joint with the terminal jack 41. At this moment, the signal contact point 321 of the signal terminal 32 is in conductive contact with the signal contact point 411 of the terminal jack 41.

Figure 6:
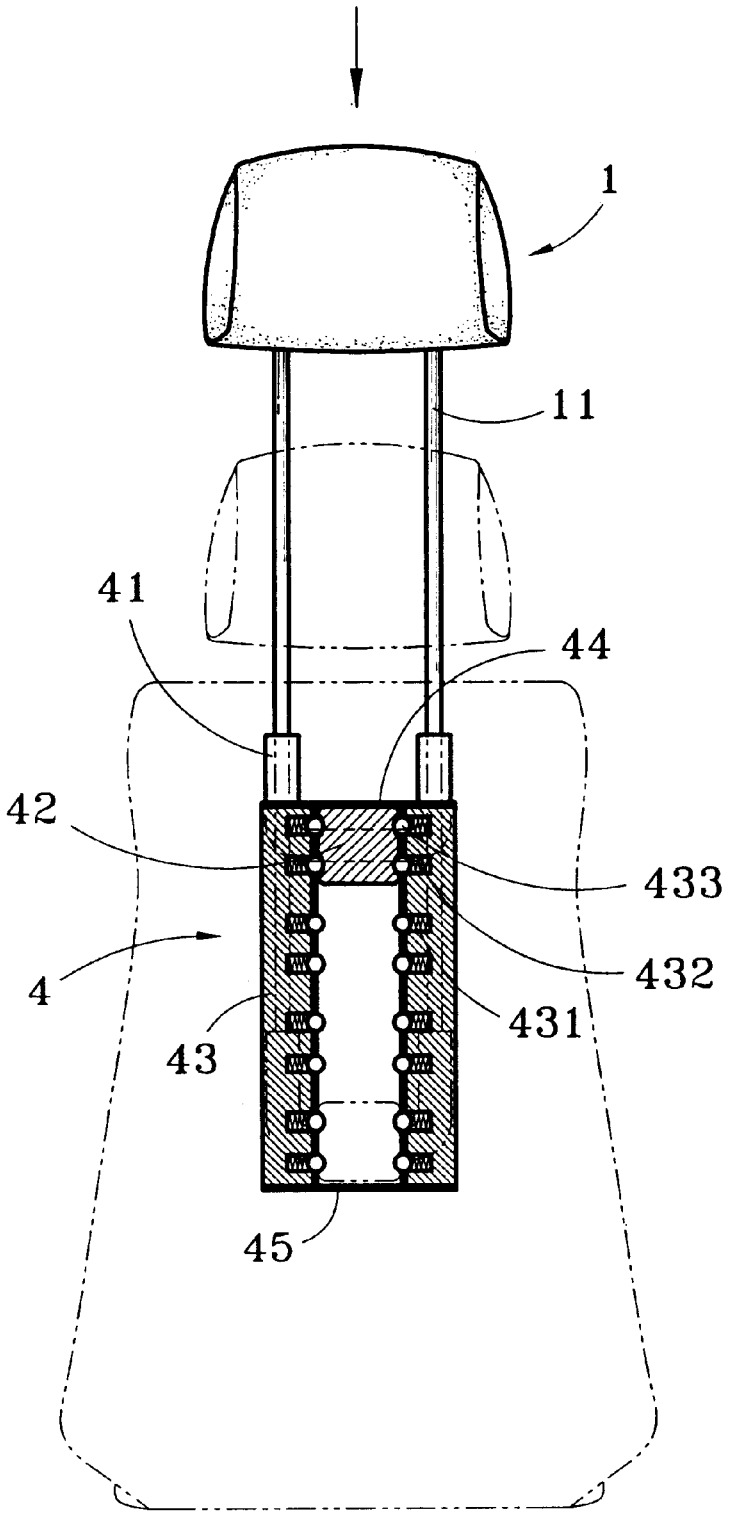
FIG. 6 is a schematic view of an adjustment device of this invention.

In FIG. 6, after the signal terminals 32 have been snap-retained in the terminal jacks 41 of the adjustment device 4, the mobile video device 3 is movable up and down along the displacement rails 43 by virtue of the displacement block 42. As abovesaid, at the upper and the lower end of the adjustment device 4, the upper and the lower stopper 44, 45 are disposed respectively for easy dismounting or mounting of the mobile video device 3, and the exit hole 416 is perforated at the bottom end of the terminal jack 41 for extending the signal transmission line 46. Further, a plurality of positioning dimples 421 is disposed at two lateral lines properly in the displacement block 42 while a plurality of storage receptacles 431 is formed in those two displacement rails 43, wherein an elastomer 432 and a steel bead 433 are buried in each storage receptacle 431 sequentially. Hence, the height of the pillow 1 of the mobile video device can be adjusted as desired.

In short, this invention is proposed to provide a coupling structure that is more advantageous for installing and maintaining a mobile video device, and an additional multistage that is convenient for adjusting height of the pillow of the mobile video device.

In the above described, at least one preferred embodiment has been elucidated with reference to drawings annexed, it is apparent that numerous variations or modifications may be made without departing from the true spirit and scope thereof, as set forth in the following claims.

What is claimed is:

1. A coupling structure for a mobile video device having a mobile video device buried in a pillow, the structure comprising a plurality of signal transmission lines of said mobile video device penetrating through a branch pipe of said pillow and coupled with a signal terminal at a bottom end of said branch pipe, said pillow is coupled with a seat portion by a pair of said branch pipes plugged in two insertion holes of said seat portion for being snap-retained in a pair of terminal jacks of an adjustment device so that the video signal can be transmitted as expected, and wherein said signal terminal is coupled with said terminal jack by a plurality of storage receptacles in the inner wall of said terminal jack, an elastomer and a steel bead are buried in said storage receptacle in sequence, a plurality of positioning dimples are formed on said signal terminal at positions corresponding with said storage receptacles of said terminal jack so that the steel bead of said terminal jack is pushed by said elastomer into said positioning dimple of said signal terminal, and thereby a signal contact point of said signal terminal is in conductive contact with a signal contact point of said terminal jack.

2. A coupling structure for a mobile video device having a mobile video device buried in a pillow, the structure comprising a plurality of signal transmission lines of said mobile video device penetrating through a branch pipe of said pillow and coupled with a signal terminal at a bottom end of said branch pipe, said pillow is coupled with a seat portion by a pair of said branch pipes plugged in two insertion holes of said seat portion for being snap-retained in a pair of terminal jacks of an adjustment device so that the video signal can be transmitted as expected, and wherein a plurality of elastic pieces are disposed in the inner wall of said terminal jack and a plurality of positioning dimples are formed on said signal terminal at positions corresponding with the elastic pieces, each elastic piece is snap-retained in a positioning dimple when said signal terminal is plugged to join with said terminal jack, and the signal contact point of said signal terminal is in conductive contact with the signal contact point of said terminal jack.

3. A coupling structure for a mobile video device having a mobile video device buried in a pillow, the structure comprising a plurality of signal transmission lines of said mobile video device penetrating through a branch pipe of said pillow and coupled with a signal terminal at a bottom end of said branch pipe, said pillow is coupled with a seat portion by a pair of said branch pipes plugged in two insertion holes of said seat portion for being snap-retained in a pair of terminal jacks of an adjustment device so that the video signal can be transmitted as expected, and wherein a positioning groove is formed in said signal terminal, and a positioning piece is disposed on said branch pipes to facilitate wiring of said signal terminal correctly in order to prevent said signal terminal from causing a short circuit because of improper swiveling.

4. A coupling structure for a mobile video device having a mobile video device buried in a pillow, the structure comprising a plurality of signal transmission lines of said mobile video device penetrating through a branch pipe of said pillow and coupled with a signal terminal at a bottom end of said branch pipe, said pillow is coupled with a seat portion by a pair of said branch pipes plugged in two insertion holes of said seat portion for being snap-retained in a pair of terminal jacks of an adjustment device so that the video signal can be transmitted as expected, and wherein said mobile video device is movable up and down along a pair of displacement rails by a displacement block after said signal terminals have been snap-retained in said terminal jacks of said adjustment device, at an upper end and a lower end of said adjustment device, an upper and a lower stopper are respectively disposed for easy dismounting or mounting of said mobile video device, a plurality of positioning dimples are disposed at two lateral lines in said displacement block while a plurality of storage receptacles are formed in the pair of displacement rails, an elastomer and a steel bead are buried in each storage receptacle sequentially, and by this architecture, the height of said pillow including said mobile video device can be adjusted as desired, and an exit hole is perforated at a bottom end of said terminal jack for extending a signal transmission line.

* * * * *